US007787798B2

(12) United States Patent
Parks

(10) Patent No.: US 7,787,798 B2
(45) Date of Patent: Aug. 31, 2010

(54) SYSTEM AND METHOD FOR PREVENTING PARTICULATE MATTER DEPOSITION ON CONTACT SURFACES

(75) Inventor: Bruce Parks, Bloomfiled, NY (US)

(73) Assignee: Xerox Corporation, Norwalk, CT (US)

( * ) Notice: Subject to any disclaimer, the term of this patent is extended or adjusted under 35 U.S.C. 154(b) by 203 days.

(21) Appl. No.: 12/123,696

(22) Filed: May 20, 2008

(65) Prior Publication Data

US 2009/0290898 A1 Nov. 26, 2009

(51) Int. Cl.
*G03G 21/00* (2006.01)

(52) U.S. Cl. ..... 399/98; 399/358

(58) Field of Classification Search ..... 399/98, 399/350–353, 355, 357, 358
See application file for complete search history.

(56) References Cited

U.S. PATENT DOCUMENTS 4,984,028 A * 1/1991 Tonomoto ..... 399/349
5,381,218 A * 1/1995 Lundy ..... 399/352

* cited by examiner

*Primary Examiner*—Hoang Ngo
(74) *Attorney, Agent, or Firm*—Oliff & Berridge, PLC

(57) ABSTRACT

An element, or elements, of a collection chamber which may remove excess deposition of particulate matter without interrupting or otherwise disturbing the normal operation of the device are provided. These elements may oscillate within a collection chamber and substantially remove any particulate matter which may be deposited, and accumulate, within the collection chamber over time. Such an oscillation and removal of undesirably deposited particulate matter may be performed without substantially interfering with the ability of particulate matter to travel through the chamber or space. The element or elements may comprises but are not limited to, one or more plastic wiping elements, or one or more spring-like wire form structures. Additionally, one or more post processing systems and methods, for final disposal, transformation, or processing of the particulate matter which travels through the collection chamber may be provided.

20 Claims, 3 Drawing Sheets

SYSTEM AND METHOD FOR PREVENTING PARTICULATE MATTER DEPOSITION ON CONTACT SURFACES

This disclosure is directed to systems and methods of preventing toner and other particulate deposition on contact surfaces of a chamber, such as an in an exemplary toner collection and distribution system.

BACKGROUND

Printers, copiers, and other types of image forming devices have become necessary productivity tools for producing and/or reproducing documents. Such image forming devices include, but are not limited to, desktop copiers, standalone copiers, facsimile machines, photographic copiers, laser printers and copiers, and multi-function devices which may comprise one or more of the above devices and other like systems capable of producing, and/or reproducing image data from an original document, data file or the like. During the image production or reproduction process, it is known that toner or other printing material particles may be removed from a printing surface, in order to remove any loose particles that may adversely affect image quality or like characteristics of a final printed document. Devices or units that may more generally remove particulate matter from a substrate, and further collect and/or sequester excess unwanted particulate matter, may also be embodied in conventional systems, as discussed below.

In certain conventional systems, a rotating brush or other abrasion element may be made to contact a substrate to dislodge particulate matter that is desirably removed prior to generation of a final finished output product. This additional, removed particulate matter may be carried by a brush to a separate unit within the device into which the removed particulate matter is collected for disposal. For example, a rotating brush may collect and carry particulate matter to be disposed of in a designated collection area for such matter. Many types of abrasion elements, such as, but not limited to, rotating brushes and wiper blades, are used to achieve a substantially similar functional result.

Once removed from the target substrate, excess particulate matter adhering to the abrasion element may need to be removed from the abrasion element using one or more known methods. For example, a brush element may be placed in contact with a non-moving protrusion to disturb the elements of the brush to which the excess particulate matter is attached. As the brush is moved past the protrusion, the individual elements are jostled so that the particulate matter is dislodged from the brush into a region or other cavity that collects the particulate matter.

Other methods of removing particulate matter from an abrasion element include externally striking or agitating the entire abrasion element to dislodge particulate matter. Such an external strike may be referred to as "thumping" the abrasion element.

Once the excess particulate matter is collected in an area or a plurality of areas, additional systems and methods may be employed to remove the particulate matter from the device, or to otherwise dispose of, recycle, or transform the particulate matter for additional useful processes.

The excess particulate matter may be removed from a collecting chamber by the application of a vacuum or a negative pressure to the collecting chamber. In other words, as an abrasion element removes and deposits particulate matter into the chamber, a vacuum or other negative pressure atmosphere is formed in the chamber to suction or otherwise direct the matter out of the device, or to another portion of the device for separate processing. The abrasion element and collection chamber are cooperatively oriented in any potential configuration to facilitate particulate matter removal. The vacuum or negative pressure environment is configured to sufficiently counteract gravitational or other forces which may force the particulate matter in a particular direction in these conventional systems.

Other systems designed to remove collected excess particulate matter include those employing auger-type or other like mechanical devices to mechanically transport particulate matter out of a collection chamber for disposal, further use, or another application. In these systems, the abrasion element is located above the collection chamber, and the auger or other mechanical removal device is located in the bottom of, or in a position below, the collection chamber. In this configuration, particulate matter removed from the abrasion element by a protrusion or other means, falls from the abrasion element to the collection chamber and further into or onto a removal element, such as an auger. Then, the removal element is actuated to move the particulate matter to a designated region of the collection chamber, or out of the collection chamber, as desired. In this manner, a simplified mechanical system may be substituted for the negative pressure/vacuum chamber to remove or sequester the particulate matter.

However, though the particulate matter may be directed from an abrasion element through a collection chamber to a means of removing the matter from a device or to another region of a device, particulate matter may nonetheless collect in portions of the chamber. Over time and extended use, unwanted collected particulate matter can reduce the flow of the particulate matter through the chamber due to increased deposition. In advanced cases, the increased deposition of particulate matter causes severe restriction or blockage of a path or other direction of movement of excess particulate matter from the abrasion element out of the system.

Conventional systems attempt to counteract the adverse deposition of particulate matter by incorporating a thumping system or method separately to dislodge excess particulate matter deposited in a collection chamber. Thumping, however, may provide unnecessarily large jarring forces or other disturbances in a device, which may result in adverse effects in the device, such as, for example, misalignment of printing heads on a substrate due to the thumping operation. Further, many devices are not compatible with the application of a thumping operation, such as large scale heavy machinery. In these instances, it may be necessary to suspend normal operation of a device in order to properly and completely clean and clear the collection chamber. Because a device may need to be removed from service in order to clear restrictions or blockages in collection chambers caused by excess deposition of particulate matter, such excess particulate matter deposition increases manufacturing costs and delays depending on the severity and frequency of accumulations of particulate matter.

SUMMARY

In view of the deficiencies in conventional systems, as discussed above, it would be advantageous to provide systems and methods for preventing particulate matter deposition on contact surfaces, particularly within collection chambers. Such systems and methods may reduce or eliminate undesired stresses and shocks to a device, while maximizing the efficiency and amount of excess particulate matter that may be removed with a minimum of disruption of the operational processes of the device.

It would be desirable to provide an element, or elements, in, or associated with, a collection chamber that may remove excess deposition of particulate matter without interrupting or otherwise disturbing the normal operation of the device.

The systems and methods according to this disclosure may reduce or eliminate blockage of collection chambers in systems that employ any movement of particulate matter through a cavity, chamber, recess, container, throughway, or other path by which particulate matter may be collected or otherwise directed for disposal, transformation, or other processing.

The systems and methods according to this disclosure may provide a collection chamber or other recess, cavity, region, or space through which particulate matter may travel. Further, at least one element to remove the particulate matter which may be deposited in the chamber, by oscillation, or other movement of the element or elements, may be provided.

The systems and methods according to this disclosure may provide a plurality of abrasion elements, which may remove or collect particulate matter from a source substrate or structure from which particulate matter is to be removed. Alternatively, the abrasion elements may remove particulate matter from other abrasion elements or provide other intermediate systems and methods for moving particulate matter from a source substrate to a collection chamber.

Further, the abrasion elements themselves may employ mechanical, electrostatic, chemical, or other means to remove particulate matter from the substrate, or adjoining abrasion element, in a system which may employ a sequence of multiple abrasion elements prior to collection of particulate matter in a collection chamber.

The systems and methods according to this disclosure may provide a plurality of means for facilitating the movement of particulate matter through the collection chamber. These movement facilitation systems and methods may comprise, but are not limited to, electrostatic charging of particulate matter, the application of a vacuum or negative pressure in the collection chamber, or other means. Additionally, gravity may be used, either alone or in combinations, with at least the exemplary facilitation systems and methods discussed above, to efficiently move particulate matter through the collection chamber.

The systems and methods according to this disclosure may provide at least one oscillating element within the collection chamber to prevent deposition of materials on contact surfaces in the chamber. The at least one element may include, but may not be limited to, one or more plastic wiping elements, or one or more spring-like wire form structures.

The systems and methods according to this disclosure may provide one or more systems and methods for final disposal, transformation, or processing of the particulate matter that is transported through the collection chamber. Such post processing systems and methods may comprise, but are not limited to, storage, waste auger transportation, or environmental discharge.

These and other features and advantages of the disclosed embodiments are described in, or apparent from, the following detailed description of various exemplary embodiments.

BRIEF DESCRIPTION OF THE DRAWINGS

Various exemplary embodiments of the disclosed systems and methods will be described, in detail, with reference to the following figures, wherein.

DETAILED DESCRIPTION OF EMBODIMENTS

The following description of various exemplary embodiments of systems and methods for preventing toner deposition on contact surfaces may refer to any system or method incorporating units or devices for the removal of particulate matter that may be disposed on surfaces of a chamber or space, by at least one oscillating element within that space.

Further, the removal using the oscillating element or elements may be performed without interrupting, or substantially affecting, the normal operation of any system which may incorporate the processing, or movement, of particulate matter through a chamber, region, or other space.

Figure 1:
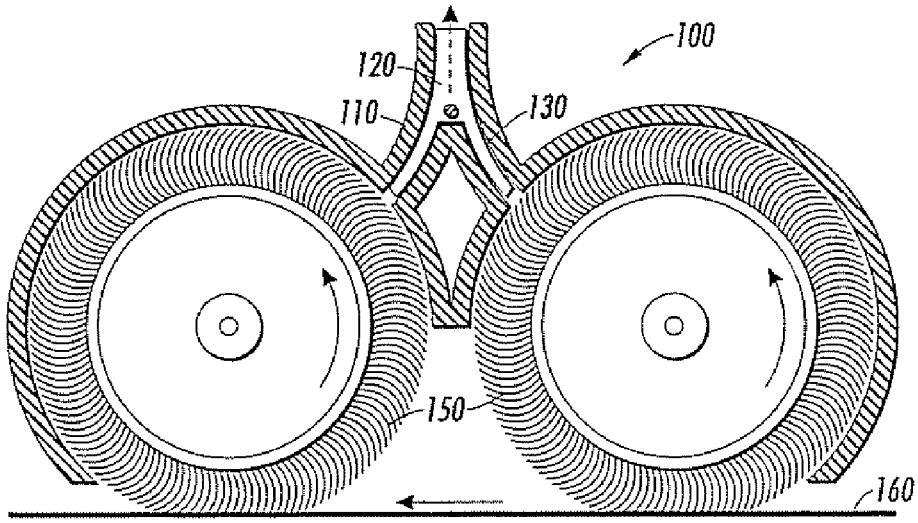
FIG. 1 illustrates an exemplary system for removing particulate matter using an airflow chamber.

FIG. 1 illustrates an exemplary system 100 for removing particulate matter using an airflow chamber.

The removal of particulate matter from a substrate or other source to a final processing, destruction, or disposal area, may incorporate a plurality of systems and steps. As shown in exemplary airflow system 100, an airflow chamber 130 may be formed by external housings 110. These external housings 110 may comprise permeable or non-permeable substances, may incorporate electrostatic, chemical or other means for attracting or repelling particulate matter, and may be formed in any shape or configuration that facilitates the flow of particulate matter through the airflow chamber 130.

In the exemplary system 100, the airflow chamber 130 takes the shape of a Y-type structure to provide separate channels for a plurality of abrasion structures, as shown by the cleaner brushes 140. Any number of cleaner brushes 140, and associated air channels, may be provided to completely, or substantially satisfactorily connect the abrasion structures to the channels of the chamber airflow chamber 130. Each cleaner brush 140, rotates to remove particulate matter from a substrate element 160, and comprises a plurality of abrasion elements 150, such as, but not limited to, bristles. The abrasion elements 150 and the structure of the cleaner brush 140 facilitate the movement of particulate matter from a substrate 160 to the airflow chamber 130. The substrate 160 may include, for example, a belt or any other structure, from which particulate matter may be removed.

In this exemplary embodiment, a negative pressure or vacuum environment may be generated in the airflow chamber 130 to facilitate movement of particulate matter from the abrasion elements 150 of the cleaner brush 140, through the airflow chamber 130, for downstream processing, disposal, destruction, or other handling of the particulate matter. This negative pressure may be a complete vacuum, or any negative pressure that is of a magnitude sufficient to increase the likelihood that particulate matter may be removed from the abrasion elements 150 through the airflow chamber for final processing.

During this exemplary process of movement of particulate matter through the negatively-pressurized airflow chamber 130, particulate matter may, over time, become deposited on the surfaces of the housings 110 of the airflow chamber 130. It is desirable to minimize, or substantially eliminate, the deposition of particulate matter in the airflow chamber 130, which, when allowed to accumulate, may negatively impact the operation of the airflow removal system. Specifically, an undesirably high level of particulate matter deposition in the airflow chamber 130 may reduce the amount of particulate matter which may travel through the airflow chamber 130, and further constrict the pathway through which the particulate matter travels. Eventually, the accumulation of particulate matter in the airflow chamber 130 may cause a blockage of the airflow chamber 130, and therefore a failure of the system to transmit particulate matter. Once such a failure occurs, it may be necessary to stop, or otherwise undesirably alter, the operation of the system 100 to remove the excessively deposited particulate matter and resume normal operation of the system 100.

An airflow channel wiper 120, as provided in the exemplary system 100 shown in FIG. 1, may be provided to oscillate within the airflow chamber 130 and scrape, or otherwise remove particulate matter from the internal housing surfaces 110 of the airflow chamber 130. The oscillating element may comprise other structures, as will be further discussed below.

Figure 2:
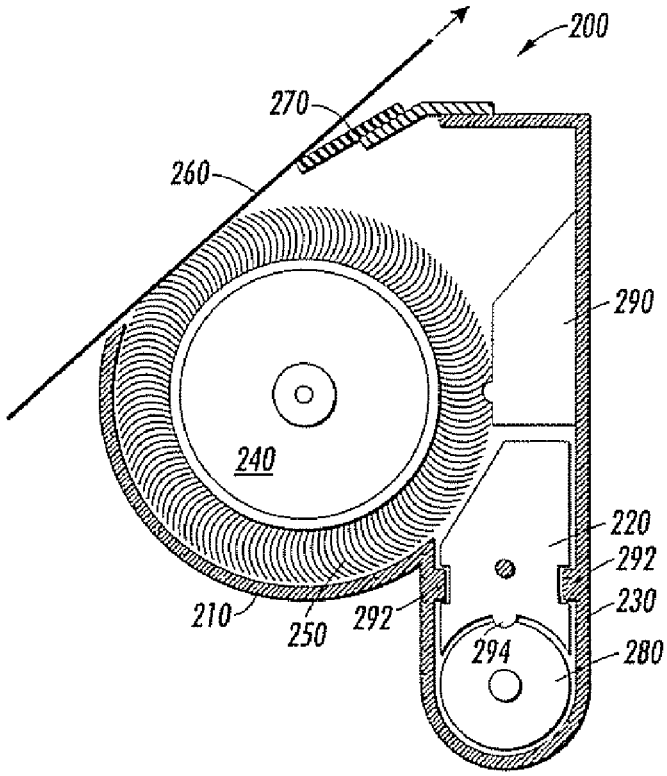
FIG. 2 illustrates an exemplary system for removing particulate matter using a gravity-based collection chamber with a waste auger for removing collected particulate matter.

FIG. 2 illustrates an exemplary system 200 for removing particulate matter using a gravity-based collection chamber 230 with a waste auger 280 for removing collected particulate matter.

As shown in FIG. 2, an exemplary system 200 may facilitate gravity-based removal of particulate matter, coupled with a mechanical auger-type particulate matter removal system. The system 200 may share similarities with the airflow-based system 100, as shown in FIG. 1. Specifically, the gravity-based system 200 may incorporate a housing 210 that forms the chamber 230 and other necessary regions, a mechanical structure 240 incorporating at least one abrasion element 250, and a substrate 260 from which particulate matter is to be removed. Further, the gravity-based chamber 230 may correspond in shape, or other characteristics, to a chamber incorporating an airflow, or other method for particulate matter movement. Finally, an oscillating element 220 such as, but not limited to, a wiper or wire form-type structure, may be provided in the chamber 230 to minimize or eliminate the deposition of particulate matter in the chamber, which is meant to substantially completely travel through the chamber.

Additionally, the gravity-based system 200 may employ additional structures in order to substantially satisfactorily remove particulate matter from a source or substrate 260. In order to ensure that substantially all undesired particulate matter may be removed from the substrate 260, a blade 270 or other scraping, abrasion, or solid mechanical removal element may be provided. The particulate matter removed by the blade 270 in this manner may fall to the mechanical cleaner brush 240 and be captured in abrasion elements 250.

Once the particulate matter is, in this example, deposited in or on the abrasion elements 250, the exemplary cleaner brush 240 may rotate toward the gravity chamber 230. As the abrasion elements 250 travel towards the chamber, an agitator element 290 may provide a surface by which the abrasion elements 250 are moved or otherwise disturbed to remove the particulate matter and facilitate its movement into the chamber 230. For example, as shown in exemplary system 200, a solid, non-moving member 290 may be abutted against abrasion elements 250 such that the abrasion elements 250 are pushed and released due to compression near the chamber 230. Once the abrasion elements 250 are released, they quickly snap into their original position, releasing the particulate matter into the chamber 230.

Once the undesired particulate matter has entered the gravity chamber 230, it should fall to the bottom-most portion of the gravity chamber 230 due to gravity. Here, a waste auger 280 may be provided to laterally facilitate the movement of the particulate matter along the bottom surface of the gravity chamber 230, and further to a final location where the particulate matter may be further processed, disposed of, destroyed, or otherwise handled.

The gravity-based system 200 may also incorporate an oscillating element, such as the wiper blade-based oscillating element 220, in order to minimize or prevent the deposition of particulate matter in the gravity chamber 230 itself.

Further, in order to prevent deposition of particulate matter on the surface of the oscillating element 220 itself, a mechanical structure may be provided in order to temporarily deform the oscillating element 220 so that particulate matter may be ejected when the oscillating element 220 returns to its original shape. For example, an extending element 294 may be provided which may touch the waste auger 280 at a bottom-most portion of the exemplary oscillating element 220. As the oscillating element 220 travels along the gravity chamber 230 in an oscillation, the element 294 may stretch, bend, or otherwise deform, the oscillating element 220 temporarily. When the oscillating element 220 moves past the portion of the auger against which it may be deformably abutted, the oscillating element 220 may snap back to its original shape, thereby ejecting additional particulate matter which may have been deposited on the oscillating element 220 itself. Additionally, guide elements 292 may be provided to further ensure controlled oscillation of the oscillating element 220 within the gravity chamber 230.

Figure 3:
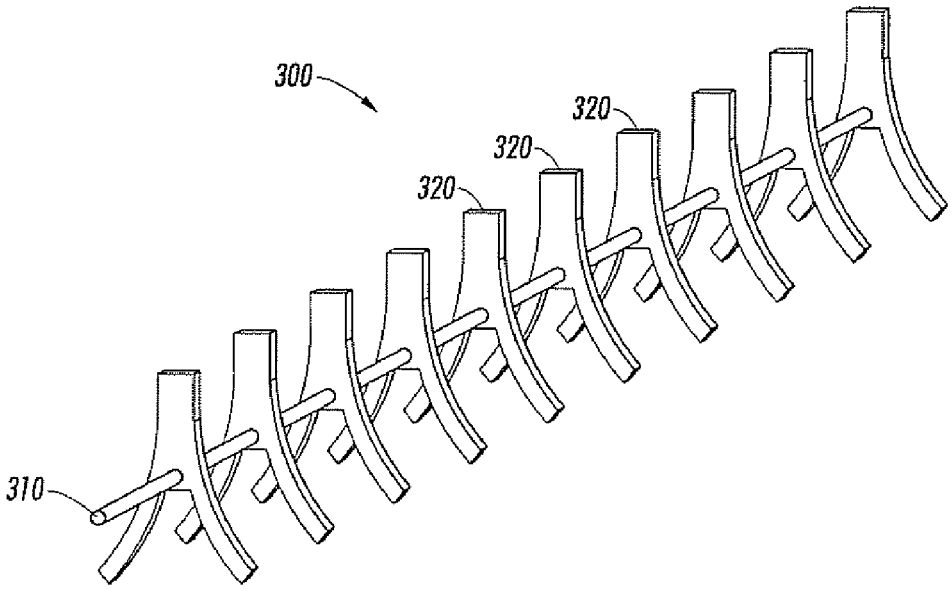
FIG. 3 illustrates a three-dimensional view of an exemplary oscillating element to remove particulate matter incorporating wiper blades.

FIG. 3 illustrates a three-dimensional view of an exemplary oscillating element 300 to remove particulate matter incorporating wiper blade-type element 320.

An exemplary oscillating element 300 may take the form of at least one wiper blade-type element 320, which may oscillate along the length of the chamber. A guide element 310, rod, or other structure, may be provided in order to connect each wiper blade-type element 320 to an oscillator, or other mechanical, electrical, electro-mechanical, or other type of oscillator. As shown in the exemplary embodiment 300, a plurality of wiper-type blades 320 are provided in the oscillating element 300. The three dimensional view shows that gaps between the plurality of wiper-type blades 320 may be present. These gaps, which may remain open during the operation of the system incorporating the oscillating element 300, ensure that the ability of particulate matter to travel through the chamber during, or in substantial concordance with, the operation of the plurality of wiper-type blades 320, may be preserved.

Each of the plurality of wiper-type blades 320 320, and the guide element 310, may be comprised of materials which resist, or eliminate, the accumulation and deposition of particulate matter.

Figure 4:
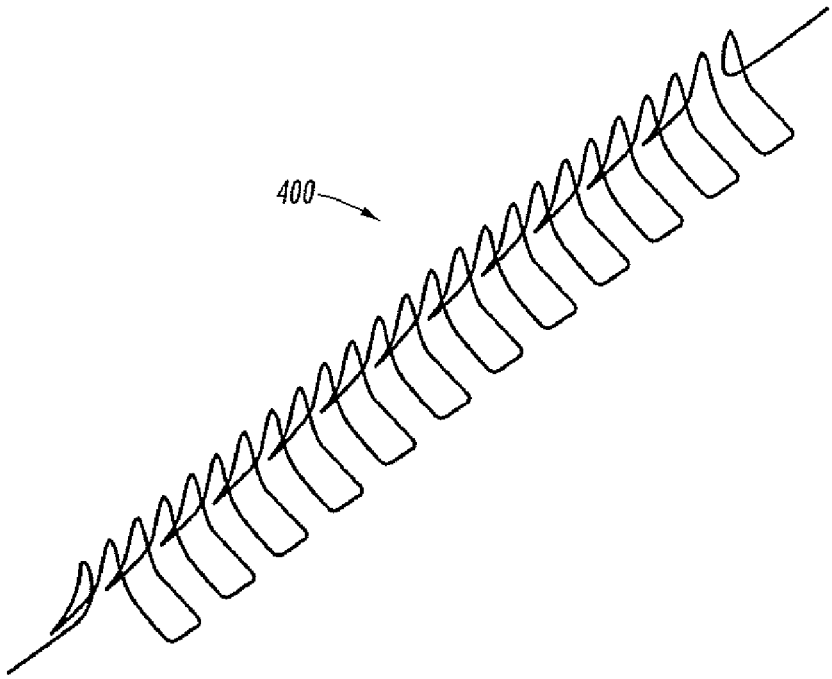
FIG. 4 illustrates a three-dimensional view of an exemplary oscillating element to remove particulate matter from a chamber incorporating a wire form structure.

FIG. 4 illustrates a three dimensional view of an exemplary oscillating element 400 to remove particulate matter from a chamber incorporating a wire form structure.

An oscillating element 400 may comprise one or more wire form elements 420 which may then be used to remove particulate matter deposited on the chamber walls. Further, the oscillating wire form element 400 may comprise a pliable metallic core. The metallic core may be coated with, or may itself comprise additional materials which may repel or otherwise decrease the accumulation of particulate matter on the wire form oscillating element itself, and may employ similar materials or structures similar to the wiper blade-type oscillating element shown in FIG. 3.

Figure 5:
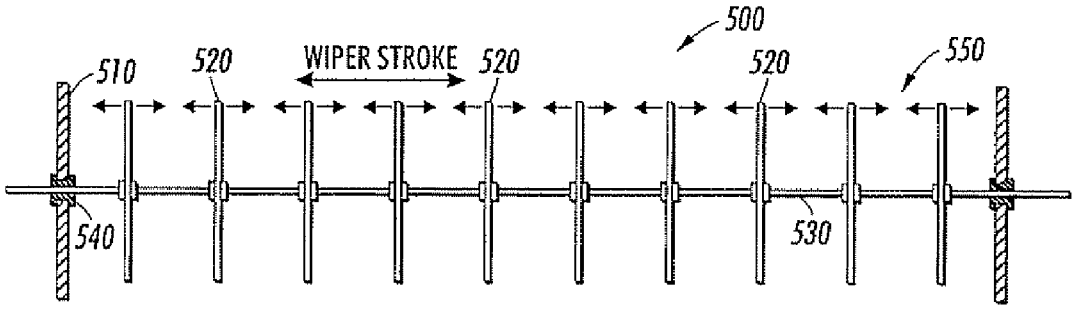
FIG. 5 illustrates an exemplary system incorporating a wiper blade-type oscillating element within a chamber.

FIG. 5 illustrates an exemplary system 500 incorporating a wiper blade-type oscillating element 520 within a chamber 550.

An oscillating element, as shown in the exemplary system of 500 as incorporating a wiper blade-type oscillating element 520, may be incorporated into a chamber. The oscillating element connects to chamber housing 510 through the exemplary connecting element 530. In order to preserve a substantially significant seal between the chamber and an outside environment, a bushing or seal 540, or other element which may desirably limit the movement of particulate matter through the connecting element-attachment point or points, may be provided. The oscillation may then be performed frown an external oscillator connected to the access element 530.

Figure 6:
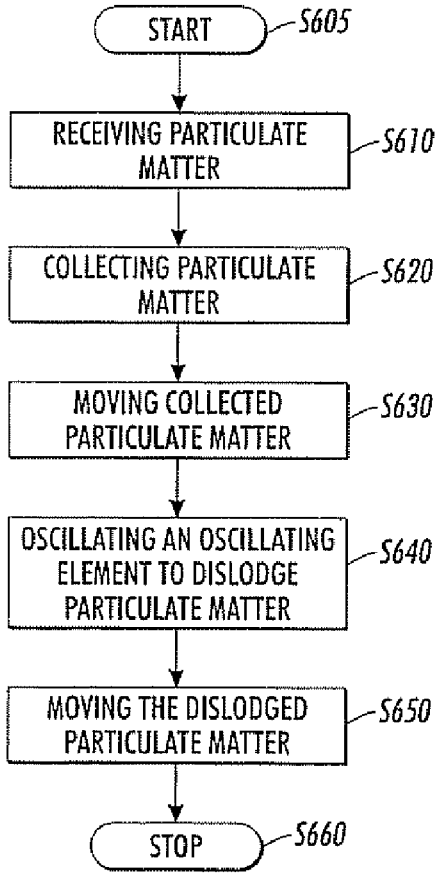
FIG. 6 illustrates an exemplary method of removing particulate matter deposited in a collection chamber.

FIG. 6 illustrates an exemplary method of removing particulate matter deposited in a collection chamber.

At step S605, a method for moving particulate matter deposited in a collection chamber begins.

At step S610, particulate matter from an external source may be received in a collection chamber. This particulate matter may be received from a substrate, abrasion elements, or other sources. This particulate matter is received into the collection chamber.

At step at S620, particulate matter received from an external source enters the collection chamber. Once the particulate matter enters the collection chamber, the particulate matter may be collected from the one or more sources or substrates. The collection chamber, therefore, may provide a centralized location for particulate matter to be removed from a substrate.

At step S630, the particulate matter collected in the collection chamber is moved to a second location. The particulate matter may be moved using for example, but not limited to, a negative or vacuum pressure environment or a waste auger or other mechanical means.

At step S640, particulate matter which may not be collected and moved in steps S620 and S630 may remain as particulate matter deposited in the collection chamber. Such particulate matter, once deposited, may be difficult or impossible to remove using a negative pressure, vacuum pressure, or gravity-based means. In order to dislodge such deposited particulate matter, an oscillating element, such as, but not limited to, a wiper blade oscillating element as shown in FIG. 3 or a wire form type oscillating element as shown in FIG. 4, may be oscillated to scrape or otherwise remove particulate matter deposited on the surfaces of the collection chamber. Once removed from the surfaces on which it is deposited, the particulate matter may be moved through the collection chamber.

At step S650, particulate matter which has been successfully dislodged from the surfaces all of the collection chamber, may now be moved through the collection chamber. This movement of dislodged particulate matter through the collection chamber may occur concurrently with the movement of particulate matter through the collection chamber which is not deposited, or may otherwise be removed without the oscillation of the oscillating element.

At step S660, a method for moving particulate matter deposited in a collection chamber ends.

It is to be appreciated that, although the above exemplary embodiments include, as shown in FIG. 1, a cleaning element 140 incorporating additional abrasion elements 150, more, fewer, or no cleaning elements may be provided, each cleaning element including, or lacking, one of more abrasion elements.

It is also to be appreciated that cleaning elements may be of differing shapes, sizes, and configurations. Further, abrasion elements may incorporate any one or more of mechanical, electrostatic, mechanical, or other means for the removal of particulate matter from a source or substrate. Each cleaning element need not be identical in the system.

It is further to be appreciated that though an oscillating element may take the form of a wiper blade-type or wire form-type structure, additional structures that are known, or may become known, may be used in a similar manner to remove deposition of particulate matter, without substantially interrupting the normal operation of the system, or substantially restricting or blocking the ability of particulate matter to travel through the chamber.

The above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of removing particulate matter deposited in a collection chamber, the method comprising:

receiving particulate matter in a collection chamber from a first location;

collecting the particulate matter in the collection chamber;

moving the collected particulate matter to a second location;

oscillating an oscillating element within the collection chamber to dislodge particulate matter in the collection chamber; and moving the dislodged particulate matter to the second location.

2. The method according to claim 1, further comprising oscillating the oscillating element during the movement of the particulate matter though the collection chamber, without substantially inhibiting movement of particulate matter through the collection chamber.

3. The method according to claim 1, further comprising oscillating the oscillating element during the movement of the particulate matter through the collection chamber.

4. The method according to claim 1, further comprising providing a negative pressure environment or a vacuum environment in the collection chamber.

5. The method according to claim 1, further comprising providing a gravity-based environment in the collection chamber.

6. The method according to claim 1, further comprising receiving the particulate matter from at least one of a particulate matter source, an abrasion element, and another collection chamber.

7. The method according the claim 6, further comprising receiving the particulate matter from a blade-type element which removes the particulate matter from a substrate.

8. The method according to claim 1, further comprising transmitting the particulate matter with at least one of employing a mechanical movement device and applying a negative pressure or vacuum.

9. A system of removing particulate matter deposited in a collection chamber, the system comprising:

means for collecting particulate matter from a first location and transporting the particulate matter to a second location;

means for removing deposited particulate matter from the collection chamber by oscillating an oscillating element within the collection chamber.

10. An apparatus for removing particulate matter, the apparatus comprising:

a chamber to collect particulate matter from a first location and to facilitate transport of the particulate matter to a second location; and an oscillating element that removes deposited particulate matter from the collection chamber by oscillating the oscillating element within the collection chamber.

11. The apparatus according to claim 10, the oscillating element further comprising at least one wiper blade-type element which oscillates at least through a portion of the length of the collection chamber.

12. The apparatus according to claim 10, the oscillating element further comprising at least one wire form-type element which oscillates at least through a portion of the length of the collection chamber.

13. The apparatus according to claim 10, wherein at least one of the collection chamber and the oscillating element are formed of a material which resists the deposition of particulate matter thereon.

14. The apparatus according to claim 10, the collection chamber further comprising a device that renders negative pressure, vacuum, or gravity-based environment to the collection chamber to facilitate movement of particulate matter though the collection chamber.

15. The apparatus according to claim 10, the first location comprising at least one of a particulate matter source and another collection chamber.

16. The apparatus according to claim 10, the first location comprising an abrasion element.

17. The apparatus according to claim 16, the abrasion element comprising at least one mechanical or electrostatic device to remove particulate matter from the particulate matter source or another abrasion element.

18. The apparatus according to claim 10, further comprising a mechanical device to remove the particulate matter from the chamber to the second location.

19. The apparatus according to claim 17, the oscillating element including an extending portion at least temporarily in contact with the mechanical device to temporarily deform the oscillating element and to remove at least part of the particulate matter deposited on the oscillating element.

20. A xerographic image forming device comprising the apparatus of claim 10.

* * * * *